United States Patent [19]

Altschuler et al.

[11] 3,976,008

[45] Aug. 24, 1976

[54] PYROTECHNIC SEEDING PELLET

[75] Inventors: Samuel Altschuler, Tarzana, Calif.; Frank T. Traylor, Bartlesville, Okla.; Richard W. Ziemer, Woodland Hills; Charles A. Knight, Beverly Hills, both of Calif.

[73] Assignee: The United States of America as represented by the Secretary of the Army, Washington, D.C.

[22] Filed: Feb. 19, 1975

[21] Appl. No.: 551,433

[52] U.S. Cl. ..... 102/31; 102/6; 102/60; 102/87; 102/70 F; 89/1.5 R; 343/18 B

[51] Int. Cl.[2] ..... F42B 4/02

[58] Field of Search ..... 102/6, 27–29, 102/31, 34.4, 35, 35.6, 37.6, 39, 60, 65, 66, 87, 90, 70 F; 343/18 B, 18 E; 89/1.5 R

[56] References Cited

UNITED STATES PATENTS

| | | | |
|---|---|---|---|
| 3,009,418 | 11/1961 | Zebree | 102/28 |
| 3,088,006 | 4/1963 | Kabik et al. | 102/28 |
| 3,158,097 | 11/1964 | Brockway et al. | 102/28 |
| 3,212,441 | 10/1965 | Rosenberg et al. | 102/87 |
| 3,441,214 | 4/1969 | D'Avignon et al. | 102/6 |
| 3,550,885 | 12/1970 | Crabtree | 102/35 |
| 3,761,929 | 9/1973 | Wyatt | 343/18 B |

*Primary Examiner*—Verlin R. Pendegrass
*Attorney, Agent, or Firm*—Lawrence A. Neureither; Jack W. Voigt; Harold W. Hilton

[57] ABSTRACT

A small cylindrical pyrotechnic pellet having an igniter, a time delay, and an output charge of easily ionized material for placing a predetermined number of ions and free electrons at a predetermined position in the upper atmosphere or space.

1 Claim, 1 Drawing Figure

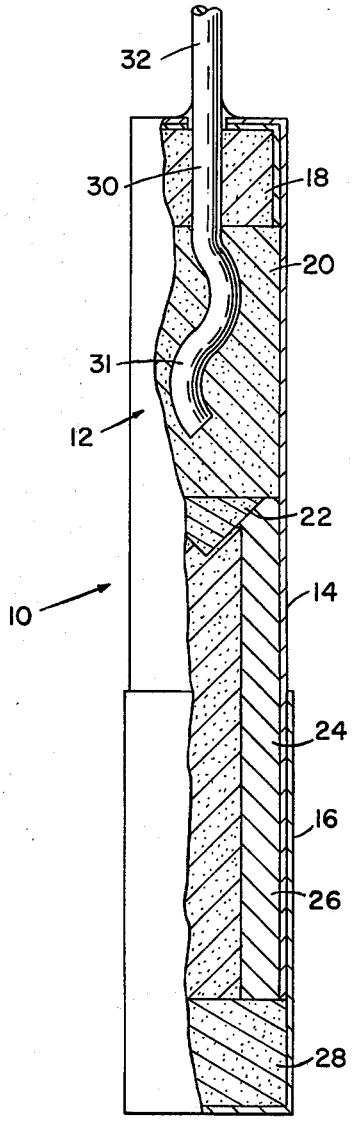
32
30
18
20
31
12
22
14
10
24
16
26
28

PYROTECHNIC SEEDING PELLET

BACKGROUND OF THE INVENTION

Apparatus of the present invention has the ability to place a fixed radar cross section a predetermined distance from a real target and to seed reentry vehicle wakes for analytical or other purposes. Injecting a predetermined number of ions and free electrons at a predetermined position in the upper atmosphere or space permits generation of a radar target, permiting calibration of ground or in-flight radars, seeding of reentry vehicle wakes to permit studies and diagnosis of wake turbulence and other wake properties.

SUMMARY OF THE INVENTION

The pyrotechnic seeding pellet of the present invention includes a housing enclosing a pyrotechnic, means for igniting the pyrotechnic, and a time delay means for delaying the time for the pyrotechnic to reach a lower charge for explosion thereof to release a predetermined number of ions and free electrons into space at a predetermined time after ignition of the pellet.

BRIEF DESCRIPTION OF THE DRAWING

The single FIGURE is a cross-sectional elevational view of the pyrotechnic pellet of the present invention.

DESCRIPTION OF THE PREFERRED EMBODIMENT

As shown in the FIGURE, the pyrotechnic seeding pellet 10 includes a housing 12 having upper and lower portions 14 and 16. The upper portion 14 houses a "striker" ignition mix 18, a "match" ignition mix 20 and a pickup charge 22. A delay column 24 is enclosed in an inner lead casing 26. The delay column and casing extend out of the upper portion 14 of housing 12 and into lower portion 16 of the housing. An output charge 28 of a material capable of providing ions and free electrons is carried in the lowermost portion of lower housing 16. A lanyard 30 is provided with a first end 31 extending into mixtures 18 and 20 and a distal end 32 extending out of upper housing 14 for secured relation with an ejecting mechanism in the vehicle. The lanyard is a wire coated with red phosphorous. An example of the striker mix may be a mixture consisting of 88% $KCLO_3$, 10% charcoal and 2% dextrin. The match mix conducts ignition to the pickup charge. An example of the match mix may be a mixture of fine charcoal, potassium nitrate and sufphur in a dextrin binder. The pickup charge is a small readily ignitable mixture of black powder with a fuel and oxidizer such as potassium nitrate and magnesium metal finely divided. The delay column consists of 89% lead chromate, 10% silicon, and 1% linseed oil. The explosive charge is a quick acting energetic mixture of Boron nitrate and a finely divided aluminum-magnesium alloy in a 50—50 ratio in which a calibrated ion producer such as cesium is blended.

In operation, the pellet is ejected from a launch tube by spring or other means well known in the art. The distal end 32 of the lanyard is secured to the reentry vehicle. The first end 31 of lanyard 30 is positioned in the flammable mixture so that as the red phosphorous coated edge of the lanyard is pulled through the striker mixture, ignition occurs. Match mixture 20 is ignited by the ignition of striker mixture 18. Pickup charge 22 is a hotter charge and is ignited responsive to ignition of mixture 20. Delay column 24 is ignited by the pickup charge and provides a slow burning rate which ignites the output charge 28 at a predetermined time after the initial ignition occurs. The output charge releases the ionized material into the air or space.

The desired delay time may be obtained by the proper selection of the length of the column or by changing the percentages of the mixture, thereby altering the burning rate.

While the above discussion has been directed to an output charge of cesium to release ions and free electrons, obviously, other materials may be resorted to in order to study wake turbulence and other wake properties or for use in other applications where it is desired to generate a radar target in the atmosphere or in space.

We claim:

1. A pyrotechnic seeding pellet disposed for ejection from a space or reentry vehicle into the atmosphere for releasing a predetermined number of ions and electrons therein, said pellet comprising:

a. a housing:

b. pyrotechnic means carried in said housing, said pyrotechnic means including a striker mix, a match ignition mix, a pickup charge, a delay column, and an output charge arranged in serial relation in said housing, said output charge disposed for release of ions and electrons responsive to ignition thereof, said output charge consisting of a mixture of boron nitrate and finely divided aluminum-magnesium alloy in a 50–50 ratio and having cesium blended therein; and, c. means for igniting said pyrotechnic including a lanyard coated with red phosphorous and having a first end thereof embedded in said striker ignition mix, the second end of said lanyard extending out of said housing in secured relation with said vehicle, whereby responsive to ejection of said pellet from said vehicle said lanyard is pulled through said striker ignition mix and the force of friction between said lanyard and striker ignition mix causes said striker ignition mix to ignite for subsequent ignition of said match ignition mix and said pickup charge.

* * * * *